US007407249B2

(12) United States Patent
Jeong

(10) Patent No.: US 7,407,249 B2
(45) Date of Patent: Aug. 5, 2008

(54) ARRAY TYPE INKJET PRINTER WITH MULTI-PASS STRUCTURE AND METHOD OF COMPENSATING AN IRREGULAR NOZZLE DEFECT THEREOF

(75) Inventor: Jin-wook Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/650,945

(22) Filed: Jan. 9, 2007

(65) Prior Publication Data

US 2008/0018702 A1 Jan. 24, 2008

(30) Foreign Application Priority Data

Jul. 21, 2006 (KR) ..... 10-2006-0068681

(51) Int. Cl.
*B41J 2/205* (2006.01)

(52) U.S. Cl. ..... 347/15; 347/41

(58) Field of Classification Search ..... 347/15, 347/41, 43, 12, 40, 19; 358/1.2, 1.9
See application file for complete search history.

(56) References Cited

U.S. PATENT DOCUMENTS

2001/0017638 A1* 8/2001 Otsuki ..... 347/41
2002/0180833 A1* 12/2002 Castano et al. ..... 347/41

* cited by examiner

*Primary Examiner*—Lamson D. Nguyen
(74) *Attorney, Agent, or Firm*—Stanzione & Kim, LLP

(57) ABSTRACT

An array type inkjet printer with a multi pass structure and a method of compensating an irregular nozzle defect thereof. The array type inkjet printer includes a scattering portion that is configured to provide a nozzle selection pattern in which a plurality of ink dots per color is arranged in a zigzag shape over a predetermined ink scattering area. The scattering portion is also configured to select a dimension of the ink scattering area along which the dots are arranged in the zigzag shape on the basis of resolution selected for printing of printing data. The inkjet printer further includes a head controller that is configured to control discharge of ink from a nozzle according to the zigzag arrangement of the dots in the nozzle selection pattern. The inkjet printer further includes a dispersion portion that is configured to modify the nozzle selection pattern by randomly rearranging the dots arranged in the zigzag shape by the scattering portion prior to dispersion of the dots over the ink scattering area. Thus, an irregular defect in a nozzle can be compensated.

17 Claims, 10 Drawing Sheets

ARRAY TYPE INKJET PRINTER WITH MULTI-PASS STRUCTURE AND METHOD OF COMPENSATING AN IRREGULAR NOZZLE DEFECT THEREOF

CROSS-REFERENCE TO RELATED APPLICATIONS

This application claims the benefit of Korean Patent Application No. 2006-68681 filed on Jul. 21, 2006 with the Korean Intellectual Property Office, the disclosure of which is incorporated herein by reference in its entirety.

BACKGROUND OF THE INVENTION

1. Field of the Invention

The present general inventive concept generally relates to an array type inkjet printer. More particularly, the present general inventive concept relates to an array type inkjet printer with a multi-pass printing structure and a method for compensating an irregular nozzle defect thereof.

2. Description of the Related Art

An inkjet printer is a printer that performs printing by spraying ink drops through a nozzle onto a printing medium, such as a sheet or a film, in response to a predetermined control signal.

An inkjet printer can be classified into a shuttle type inkjet printer or an array type inkjet printer depending on the driving mode of the printer head during printing.

A shuttle type inkjet printer is provided with a plurality of nozzles arranged in a head in a sub-scanning direction. The shuttle type inkjet printer prints one line while moving the head in a scanning direction and prints another line while moving the head in a sub-scanning direction.

On the other hand, an array type inkjet printer is provided with a nozzle and a sheet, wherein the nozzle is longitudinally arranged along a scanning direction of a head to print lines in a sub-scanning direction one by one while the sheet moves in the sub-scanning direction.

Several thousand nozzles may be formed in the head of the array type inkjet printer depending on the desired resolution or design criteria. For example, if 1200 nozzles are used to print one line, then a total of 4800 (1200×4) nozzles are formed in the head when the printer supports four-color printing using the four colors of CMYK (Cyan, Magenta, Yellow, and Black).

If a dead nozzle occurs in a part of the head of the array type inkjet printer provided with a plurality of nozzles as described above, it adversely affects output images. In this respect, in addition to the method of physically exchanging a head with another one, other methods for compensating a dead nozzle have been suggested.

Recently, a multi-pass printing structure for the array type inkjet printer has been suggested to compensate for the dead nozzle. Hereinafter, a multi-pass printing structure will be briefly described with reference to FIGS. 1 and 2.

FIG. 1 conceptually illustrates a multi-pass printing structure in an array type inkjet printer, FIG. 2 illustrates a four-color multi-pass printing method for compensating a dead nozzle in an array type inkjet printer, and FIG. 3 illustrates a problem caused by irregular discharge characteristics of a nozzle during multi-pass printing.

Referring to FIGS. 1 and 2, if a printing medium 30 is fed in a sub-scanning direction (indicated by the arrow "A") of a printer head cartridge 10, ink is discharged through a nozzle 12 so that a first pass printing operation (shown leftmost in FIG. 2) is performed and the printing medium 30 is fed back. During the first pass, ink of one of the four colors is discharged.

The printing medium 30, which remains engaged with the head cartridge 10 and a feeding roller 20, horizontally moves at a certain interval, and, hence, a second pass printing operation with a different ink color is performed as illustrated in FIG. 2. Referring to FIG. 1, the arrow A represents a feeding direction of the printing medium 30 as noted before, and an arrow B represents the direction of movement of the feeding roller 20.

As illustrated in FIG. 2, the multi-pass printing operation is repeated for each of the total number of ink colors. Thus, in case of the four-color printing illustrated in FIG. 2, the multi-pass printing operation is repeated four times so that first through fourth pass printing operations are carried out to print the whole image in four colors.

A dead nozzle can be compensated by the aforementioned multi-pass printing manner. However, in case of multi-pass printing, additional technology and cost are required for accurate control of nozzles to accomplish suitable display resolution.

Also, charge characteristics of each nozzle 12 may not be maintained uniformly due to any irregularities in the air flow into an ink chamber or user environment. In other words, although a dead nozzle situation may be remedied via multi-pass printing, an irregular nozzle defect may render the multi-pass printing useless.

For example, a white line C may occur in the printed image as illustrated in FIG. 3 due to a nozzle's irregular charge characteristics. The problem illustrated in FIG. 3 may render it difficult to maintain picture quality of a normal image when an irregular nozzle defect is present in an array type inkjet printer with a multi-pass printing structure.

SUMMARY OF THE INVENTION

The present general inventive concept provides an array type inkjet printer with a multi pass structure and a method of compensating an irregular nozzle defect thereof. The conventional linear arrangement of ink dots along a dimension of the ink scattering area is modified to rearrange the dots in a zigzag manner along that dimension and over the ink scattering area to correct printed information, so that irregular discharge characteristics of a nozzle can be compensated without removing the nozzle.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an array type inkjet printer, which prints printing data in a plurality of ink colors using a nozzle selection pattern of ink discharge. The array type inkjet printer including a scattering portion configured to provide the nozzle selection pattern by arranging a plurality of ink dots per color in a zigzag shape over a predetermined ink scattering area. The inkjet printer also includes a head controller configured to control discharge of ink from a nozzle in the inkjet printer according to the arrangement of dots in the nozzle selection pattern. In an embodiment of the present general inventive concept, the scattering portion is configured to select a dimension (e.g., in the vertical direction) of one side of the ink scattering area on the basis of a resolution selected for printing of the printing data. The ink dots are then dispersed along that dimension in the zigzag shape.

The dimension of one side of the ink scattering area can correspond to an inverse number of resolution lower than the resolution selected for printing of the printing data.

The scattering portion may increase the number of the dots arranged in a diagonal direction in the zigzag shape in proportion to the dimension of one side of the ink scattering area.

The scattering portion can arrange at least one dot in left and right diagonal directions around a dot to be printed.

The array type inkjet printer according to an embodiment of the present general inventive concept further includes a dispersion portion configured to modify the nozzle selection pattern by randomly rearranging the dots arranged in the zigzag shape by the scattering portion prior to dispersion of the dots over the ink scattering area.

The foregoing and/or other aspects and utilities of the present general inventive concept may also be achieved by providing a method of printing using an array type inkjet printer, which prints printing data in a plurality of ink colors using a nozzle selection pattern of ink discharge. The method can include arranging, as part of the nozzle selection pattern, a plurality of ink dots per color in a zigzag shape over a predetermined ink scattering area; and controlling discharge of ink from a nozzle in the inkjet printer according to the arrangement of dots in the nozzle selection pattern.

The arranging the dots in a zigzag shape may include increasing the number of the dots arranged in a diagonal direction in the zigzag shape in proportion to the dimension of the one side of the ink scattering area.

The arranging the dots in the zigzag shape may also include arranging at least one dot in left and right diagonal directions around a dot to be printed.

The method may further include modifying the nozzle selection pattern by randomly rearranging the dots arranged in the zigzag shape prior to dispersion of the dots over the ink scattering area. The present general inventive concept contemplates improvement in an array type inkjet printer wherein printing data is printed in a multi-pass manner using a plurality of ink colors and a nozzle selection pattern having a plurality of ink dots per color. In a conventional manner, the dots in each of the plurality of dots are substantially linearly aligned along a dimension of a predetermined ink scattering area. In the improved inkjet printer, the nozzle selection pattern has each of the plurality of dots per color arranged in a manner whereby dots in each of the plurality of dots are arranged in a zigzag shape along the dimension of the ink scattering area instead of the substantially linear alignment.

In an inkjet printing method wherein printing data is printed in a multi-pass manner using a plurality of ink colors and a nozzle selection pattern having a plurality of ink dots per color, and wherein dots in each of the plurality of dots are substantially linearly aligned over a dimension of a predetermined ink scattering area, the improvement according to the present general inventive concept comprises configuring the nozzle selection pattern so as to arrange each of the plurality of dots per color in a manner whereby dots in each said plurality of dots are arranged in a zigzag shape along the dimension of the ink scattering area instead of the substantially linear alignment.

The foregoing and/or other aspects and utilities of the present general inventive concept may also be achieved by providing an array type inkjet printer, which prints printing data in a plurality of ink colors using a nozzle selection pattern of ink discharge, the array type inkjet printer including a scattering portion to provide the nozzle selection pattern by arranging a plurality of ink dots per color such as to arrange at least one dot in left and right diagonal directions around a dot to be printed in a zigzag shape; and a head controller to control discharge of ink from a nozzle in the inkjet printer according to the arrangement of dots in the nozzle selection pattern.

The array type inkjet printer as claimed in 13, may further include a dispersion portion to rearrange the dots arranged by the scattering portion by randomly dispersing the dots over an ink scattering area.

The foregoing and/or other aspects and utilities of the present general inventive concept may also be achieved by providing a method of printing data in a multi-pass manner using a plurality of ink colors and a nozzle selection pattern having a plurality of ink dots per color, the method including substantially linearly aligning the dots in each the plurality of dots along a dimension of a predetermined ink scattering area, and arranging each of the plurality of dots per color in the nozzle selection pattern in a manner whereby dots in each of the plurality of dots are arranged in a zigzag shape along the dimension of the ink scattering area instead of the substantially linear alignment.

The nozzle selection pattern having dots in each of the plurality of dots per color can be randomly rearranged within the zigzag shape prior to disperse the dots over the ink scattering area.

The ink scattering area having the dimension can be selected to be an inverse number of resolution lower than the resolution selected for printing of the printing data.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
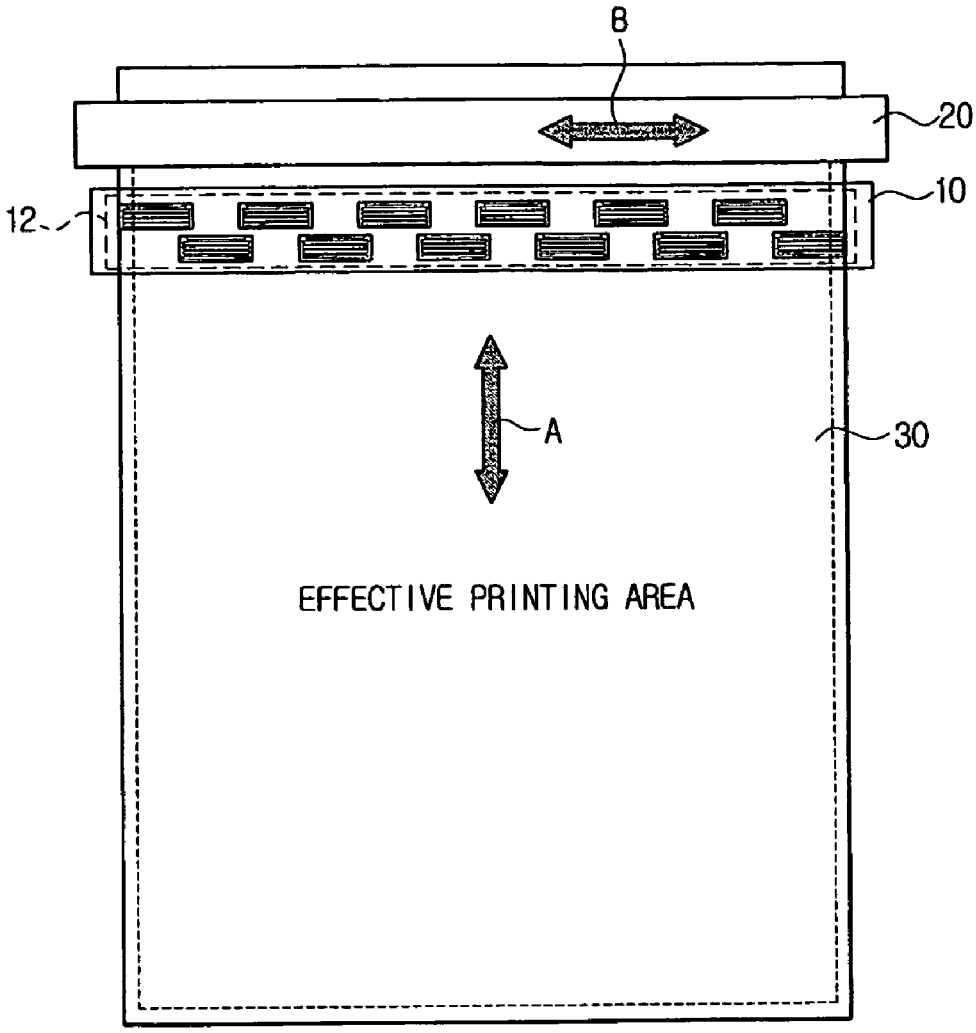
FIG. 1 (PRIOR ART)
FIG. 1 conceptually illustrates a multi-pass printing structure in an array type inkjet printer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

In the following description, well-known functions or constructions are not described in detail since they may obscure the present general inventive concept with unnecessary detail.

Figure 4:
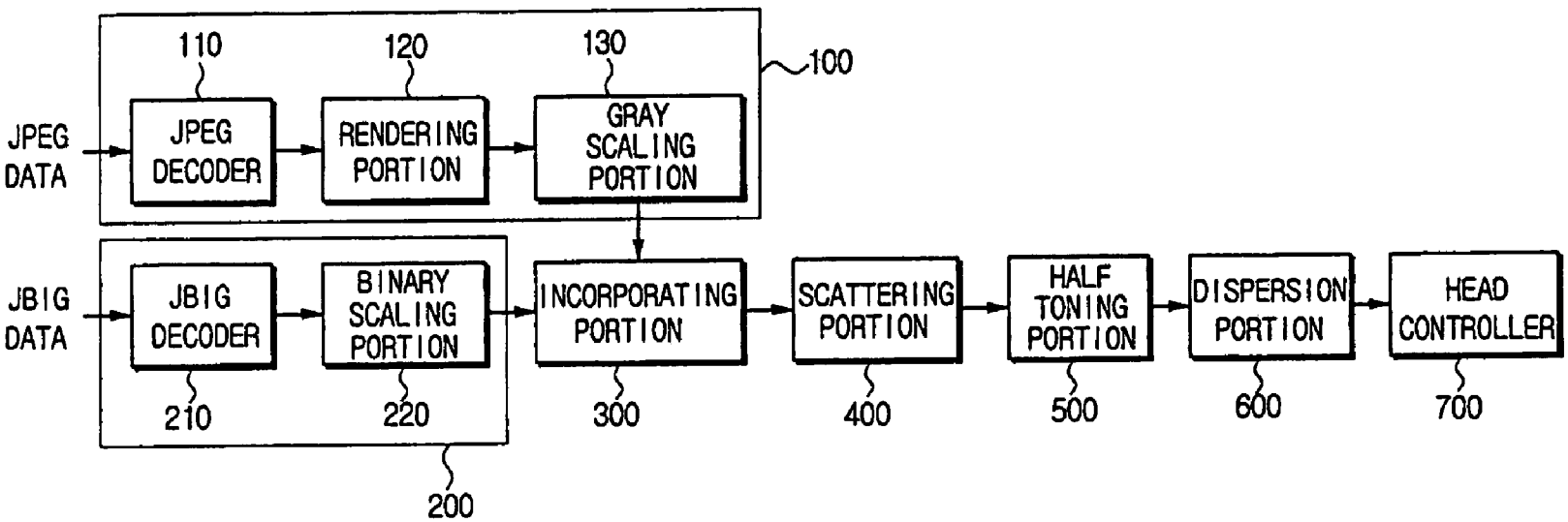
FIG. 4 is a block diagram illustrating an array type inkjet printer with a multi-pass structure according to an embodiment of the present general inventive concept.

FIG. 4 is a block diagram illustrating an array type inkjet printer with a multi pass structure according to an embodiment of the present general inventive concept.

Referring to FIG. 4, the array type printer with a multi-pass structure according to an embodiment of the present general inventive concept includes an image processor 100, a text processor 200, an incorporating portion 300, a scattering portion 400, a half toning portion 500, a dispersion portion 600, and a head controller 700.

The image processor 100 processes image data received among the printing data transmitted from a printer driver (not illustrated). Generally, the image data are JPEG (Joint Picture Experts Group) compressed image data processed by the image processor 100. The image processor 100 includes a JPEG decoder 110, a rendering portion 120, and a gray scaling portion 130.

The JPEG decoder 110 restores the JPEG compressed image data received from the printer driver.

The rendering portion 120 performs color correction for conversion from one color coordinate system to another. Generally, since JPEG compression uses a chrominance signal coordinate system such as YCC (color spaces with one Luminance and two different channels, or luminance (Y), Chrominance (Cb), and Chrominance (Cr)) or LAB (Lightness-A-B), whereas the printer may use a CMYK coordinate system, the rendering portion 120 performs conversion of the input coordinate system to a coordinate system that can be output from the printer. The conversion may be carried out using an equation for conversion of image information in different coordinate systems.

The gray scaling portion 130 enlarges image data suitable for the desired printing resolution. Generally, since gray level data are input at 300 dpi (dots per inch) or 600 dpi (e.g., from the printer driver (not illustrated)), but printing resolution of 1200×1200 dpi, 1200×2400 dpi or 1200×4800 dpi can be desired, it may be necessary to enlarge image.

A printing mode can be defined depending on the printing resolution selected. A draft mode is defined in case of printing resolution of 1200×1200 dpi, a normal mode is defined in case of printing resolution of 1200×2400 dpi, and a best mode is defined in case of printing resolution of 1200×4800 dpi.

The text processor 200 processes text data received among the printing data transmitted from the printer driver (not illustrated). Generally, the text data processed by the text processor 200 are JBIG (Joint Bi-level Image Experts Group) compressed text data. The text processor 200 includes a JBIG decoder 210 and a binary scaling portion 220.

The JBIG decoder 210 restores the JBIG-compressed text data transmitted from the printer driver (not illustrated), wherein "JBIG" is a binary image compression scheme for the text data.

The binary scaling portion 220 controls the size of the text data if a resolution of the text data is lower than printing resolution or if reduction of the text data having resolution higher than that of a gray image is required.

The incorporating portion 300 incorporates the image data, which have undergone decoding, rendering, and gray scaling through the image processor 100, into the text data, which have undergone decoding and binary-scaling through the text processor 200, thereby outputting the printing data.

The scattering portion 400 may be configured to provide a nozzle selection pattern by performing scattering of ink dots on the basis of resolution to be used for printing of printing data. The scattering portion in a conventional array type inkjet printer (not illustrated) may arrange a plurality of ink dots successively along a straight line in a vertical direction in a predetermined ink scattering area. However, the scattering portion 400 in the embodiment of FIG. 4 is configured to provide the nozzle selection pattern by arranging a plurality of dots per color in a zigzag shape along a side (e.g., in the vertical direction) in the predetermined scattering area. As discussed herein below, the dimension (along the vertical direction) of this side may be selected on the basis of resolution (e.g., 1200 dpi, etc.) to be used for printing of printing data.

The scattering portion 400 may set one side of the scattering area to have a dimension corresponding to an inverse number of resolution lower than the selected printing resolution. For example, one side of the scattering area may be set to have any one of 1/600 dpi, 1/400 dpi, or 1/300 dpi dimensions.

In an embodiment of the present general inventive concept, the scattering portion 400 can increase the number of dots arranged in a diagonal direction in the zigzag shape over the scattering area in proportion to the dimension of the one side of the scattering area along which the ink dots are to be printed in the zigzag shape.

For example, if printing resolution is selected to be 1200 dpi and one side of the scattering area has the dimension of 1/600 dpi, then two dots (1200×1/600) per color are arranged in a diagonal direction in each zigzag shape (one per color) over the scattering area. Also, if one side of the scattering area has the dimension of 1/300 dpi, then four dots (1200×1/300) per color are arranged in a diagonal direction in each zigzag shape (one per color) over the scattering area.

The scattering portion 400 can arrange a plurality of ink dots in such a manner as to arrange at least one dot in left and right diagonal directions around a dot to be printed in the zigzag shape.

Figure 2:
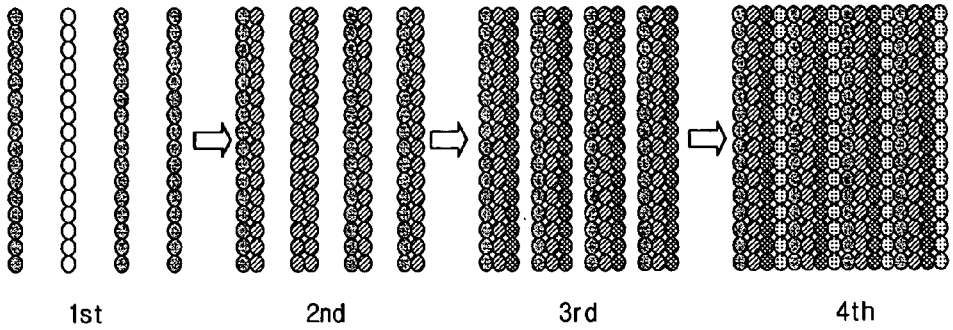
FIG. 2 (PRIOR ART)
FIG. 2 illustrates a four-color multi-pass printing method for compensating a dead nozzle in an array type inkjet printer.
Figure 3:
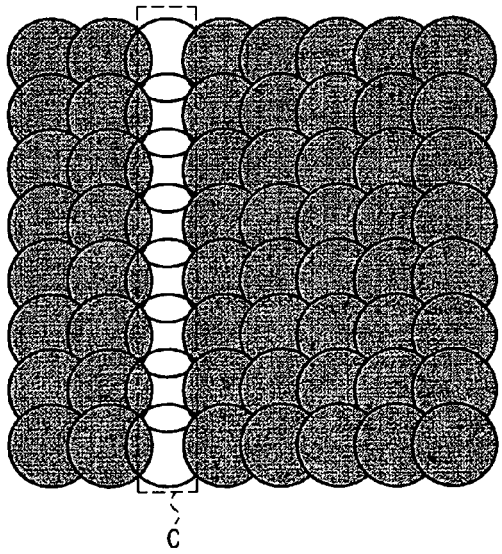
FIG. 3 (PRIOR ART)
FIG. 3 illustrates a problem caused by an irregular discharge characteristics of a nozzle during multi-pass printing.

Unlike the related art in which a plurality of dots per color are arranged in a straight line along a vertical direction, the present general inventive concept employs the scattering portion 400 that allows the plurality of dots to be arranged in a zigzag shape over an area wider than the related art ink scattering area (e.g., the scattering area shown in FIG. 2), while maintaining the same dot size.

The half toning portion 500 converts the printing data into color information that can be recognized by the printer head (not illustrated). Since a printer head has only information as to whether to discharge ink at a current head position or not to discharge ink, CMYK data of 32 bits should be converted into data of 4 bits through the half toning portion 500.

The dispersion portion 600 rearranges the dots arranged by the scattering portion 400 by randomly dispersing them over the ink scattering area, and thus re-configures the nozzle selection pattern.

If the dots are arranged in a zigzag shape by the scattering portion 400, moiré phenomenon, which refers to an interference pattern generated when two or more periodical wave patterns are overlapped with one another, may occur in the printing result. When the dispersion portion 600 randomly rearranges the dots, such moiré phenomenon caused by the dot arrangement by the scattering portion 400 can be removed.

To print the printing data, the head controller 700 controls the printer head (not illustrated) to allow a nozzle (in the printer head) to discharge ink, wherein the nozzle discharges ink in accordance with the dots newly arranged in the page information corrected by the scattering portion 400 and the dispersion portion 600.

Figure 5:
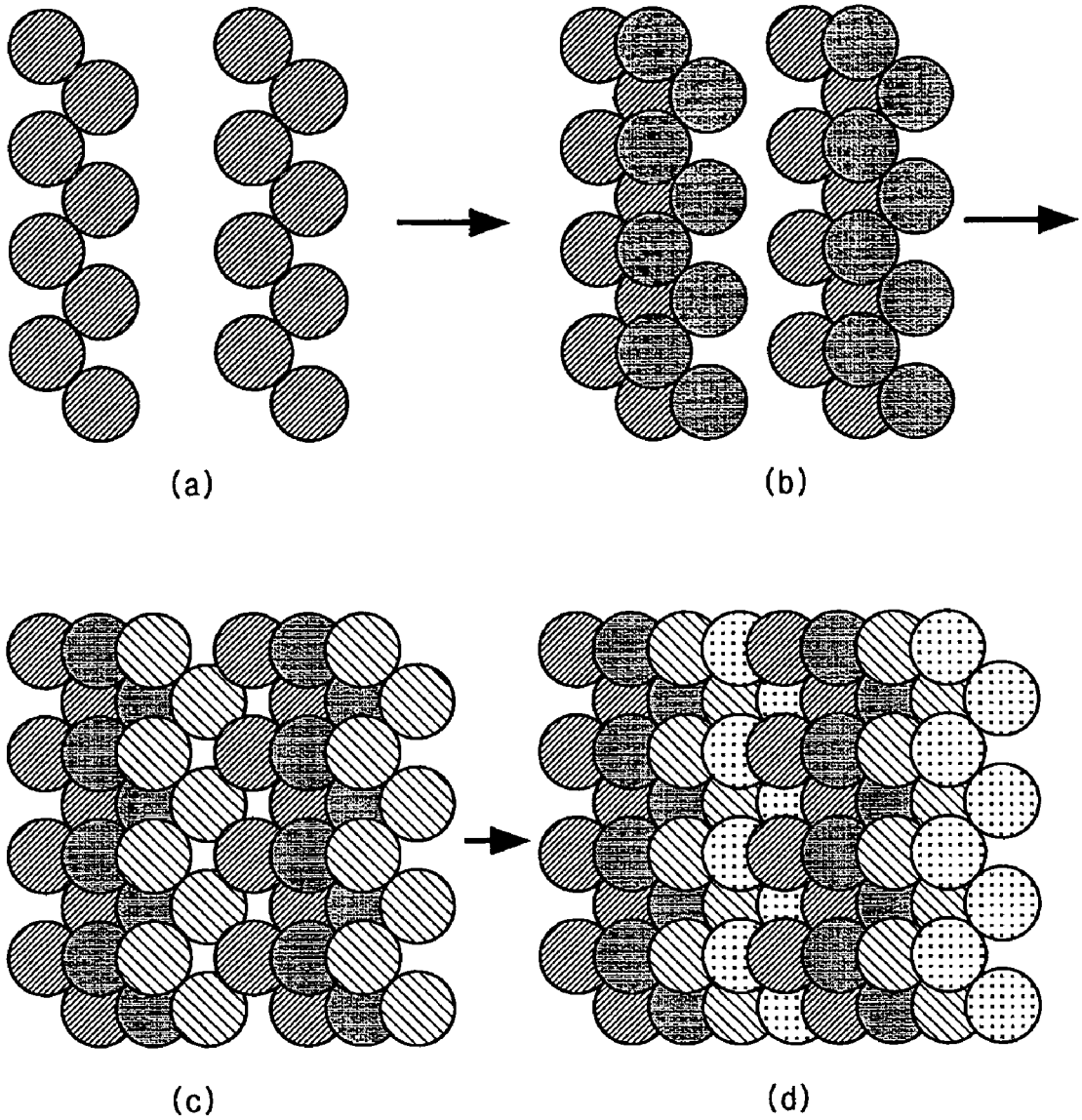
FIG. 5 illustrates an exemplary zigzag dot pattern of a four-color multi-pass printing according to an embodiment of the present general inventive concept.

FIG. 5 illustrates an exemplary zigzag dot pattern of a four-color multi pass printing according to an embodiment of the present general inventive concept.

Referring to FIG. 5, the dots arranged by the scattering portion 400 in a zigzag shape over the scattering area are exemplarily printed by the printer head in the array type inkjet printer that performs four-pass printing.

If printing resolution is 1200 dpi and one side of the scattering area has a dimension corresponding to 1/600 dpi, then, as discussed above, two dots (per color) are arranged in a diagonal direction as illustrated in FIG. 5(*a*).

In other words, if a dot to be actually printed corresponds to an nth nozzle, the nth nozzle and the n+1th nozzle can be selected to discharge ink in case of the scattering area having a side with the dimension corresponding to 1/600 dpi. Otherwise, in an alternative embodiment, the nth nozzle and the n−1th nozzle can be selected to discharge ink.

As illustrated in FIG. 5(*a*), in the first printing operations, printing is performed for a plurality of dots of the first color, which are arranged in a zigzag shape over the scattering area whose one side has the dimension corresponding to 1/600 dpi.

Afterwards, in the second pass of printing, as illustrated in FIG. 5(*b*), the printing medium (which has already performed the first pass of printing) is fed back and shifted at a predetermined interval, and printing is performed for a plurality of dots of the second color, which are arranged to be adjacent to the dots printed in the first pass and are of the same shape as the dots in the first pass (with first color).

Furthermore, as illustrated in FIGS. 5(*c*) and (*d*), printing is performed for each color-specific plurality of dots, which dots are also arranged to be adjacent to the dots printed in the previous passes and have the same shape as the dots in the previous passes. The final printing result of all four colors can be obtained as illustrated in FIG. 5(*d*).

Figure 6A:
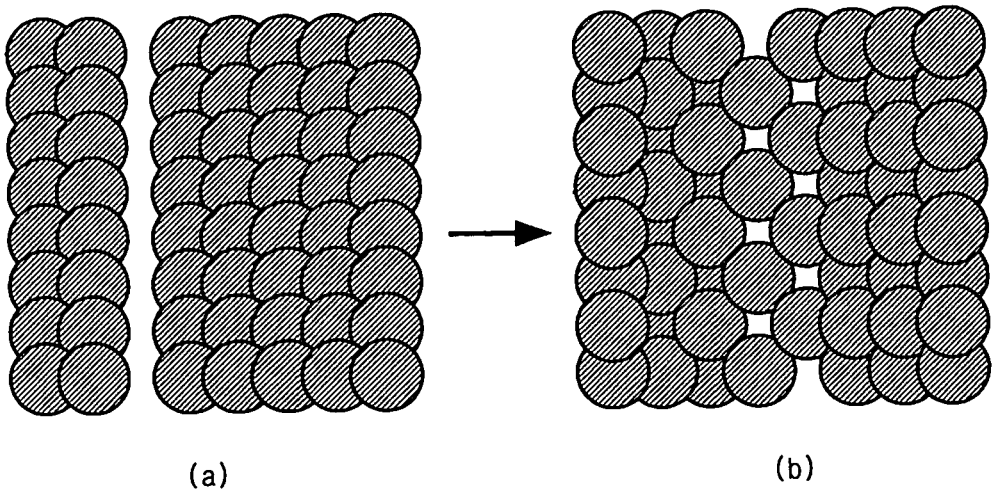
FIGS. 6A and 6B illustrate image improvement effects when the multi-pass printing steps of FIG. 5 are employed.
Figure 6B:
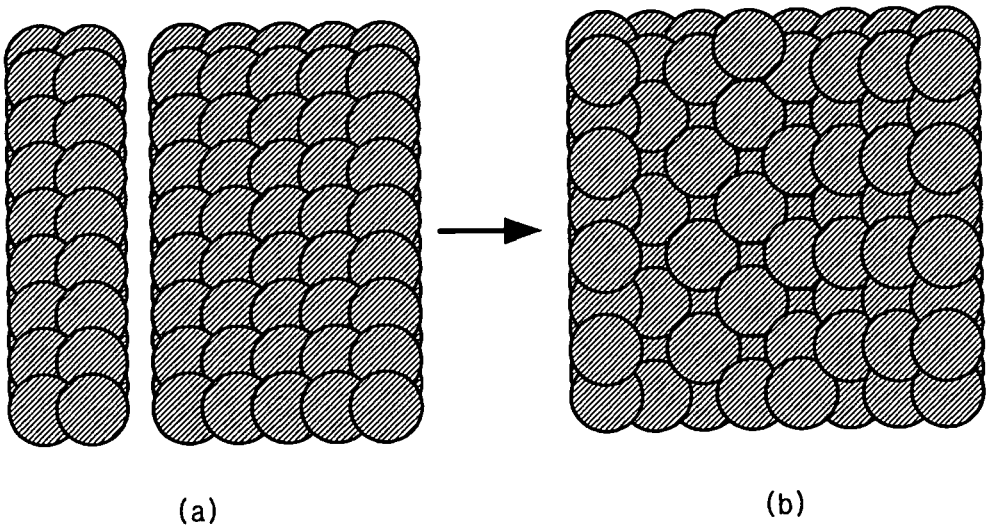

FIGS. 6A and 6B illustrate image improvement effects when the multi-pass printing operations of FIG. 5 are employed.

FIG. 6A illustrates the printing result using an array type inkjet printer of the present general inventive concept in comparison with the related art printing result if printing is performed in a draft mode, i.e., at a resolution of 1200×1200 dpi.

The part (a) of FIG. 6A illustrates an example of a multi-pass printing where a plurality of ink dots per color are arranged in a straight line in accordance with the prior art multi-pass printing. Referring to part (a) of FIG. 6A, it is noted that a white line, which affects the printing result, occurs in spite of the multi-pass printing manner when an irregular nozzle defect occurs.

The part (b) of FIG. 6A illustrates an exemplary output that can be obtained when printing is performed in a draft mode after a plurality of dots per color are arranged in a zigzag shape by the scattering portion 400 according to the present general inventive concept. Referring to part (b) of FIG. 6A, it is noted that the white line which is clearly visible in part (a) of FIG. 6A is covered.

FIG. 6B illustrates an exemplary printing result obtained using the present general inventive concept in comparison with the related art printing result when printing is performed in a normal mode, i.e., at a resolution of 1200×2400 dpi.

The part (a) of FIG. 6B illustrates an example of a multi-pass printing wherein a plurality of dots per color are arranged in a straight line in accordance with the teachings in the related art. Referring to part (a) of FIG. 6B, it is noted that when an irregular nozzle defect is present, a white line, which affects the printing result, occurs in spite of the multi-pass printing and even if the white line is thinner than that occurring in the printing results illustrated in part (a) of FIG. 6A.

The part (b) of FIG. 6B, on the other hand, illustrates an effect that can be obtained when printing is performed in a normal mode when a plurality of dots per color are arranged by the scattering portion 400 in a zigzag shape. Referring to part (b) of FIG. 6B, it is noted that the white line, which is clearly visible in part (a) of FIG. 6B, is completely covered (or removed).

Figure 7:
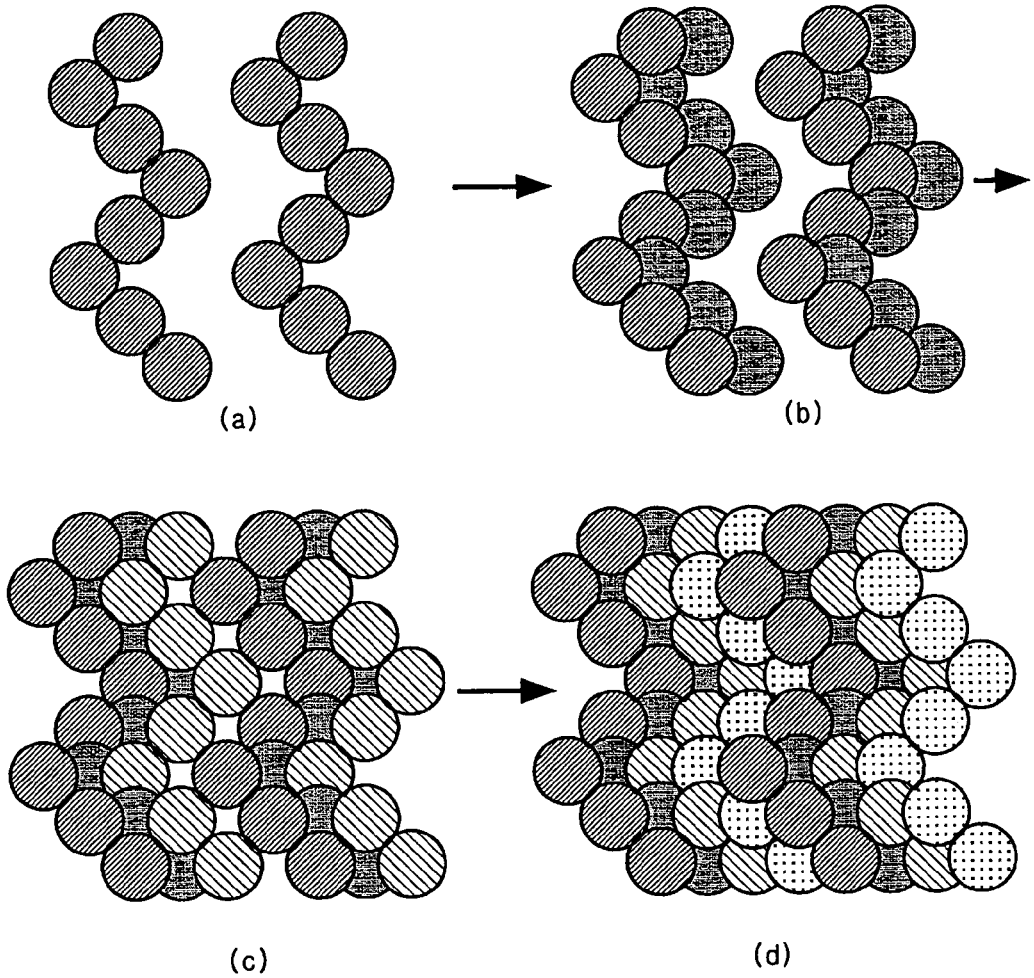
FIG. 7 illustrates exemplary zigzag shape-based multi-pass printing operations according to another embodiment of the present general inventive concept.

FIG. 7 illustrates exemplary zigzag shape-based multi-pass printing operations according to another embodiment of the present general inventive concept.

Referring to FIG. 7, the dots arranged by the scattering portion 400 in a zigzag shape over the ink scattering area are exemplarily printed by the array type inkjet printer that performs four-pass printing in the same manner as that discussed with reference to FIG. 5.

In FIG. 7, unlike FIG. 5, the printing resolution is 1200 dpi and one side of the scattering area has a dimension corresponding to 1/400 dpi. Hence, in this case, three dots (1200×1/400) per color are arranged in a diagonal direction as illustrated in part (a) of FIG. 7.

In other words, in the embodiment of FIG. 7, if a dot to be actually printed corresponds to an nth nozzle, then the n−1th nozzle, the nth nozzle and the n+1th nozzle can be determined to discharge ink in case of the scattering area having one side with a dimension corresponding to 1/400 dpi.

As illustrated in part (a) of FIG. 7, in the first printing pass using the first color, the printing is performed for a plurality of dots, which are arranged in a zigzag shape over the scattering area whose one side has the dimension corresponding to 1/400 dpi.

Afterwards, as illustrated in part (b) of FIG. 7, printing is performed for a plurality of dots using the second color, which dots are arranged to be adjacent to the dots printed in the first pass and have the same shape as that of the dots in the first pass.

Furthermore, as illustrated in parts (c) and (d) of FIG. 7, printing is further performed for a plurality of dots using the third and fourth colors, respective. The dots, as illustrated, are arranged to be adjacent to the dots printed in the previous passes and have the same shape as that of the dots in the previous passes. The final printing result can be obtained as illustrated in part (d) of FIG. 7.

Figure 8A:
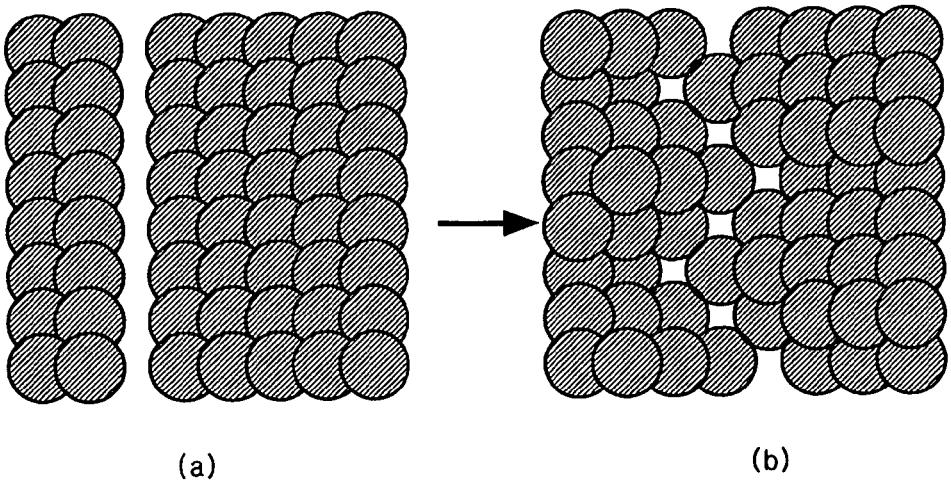
FIGS. 8A and 8B illustrate image improvement effects when the multi-pass printing operations of FIG. 7 are employed.
Figure 8B:
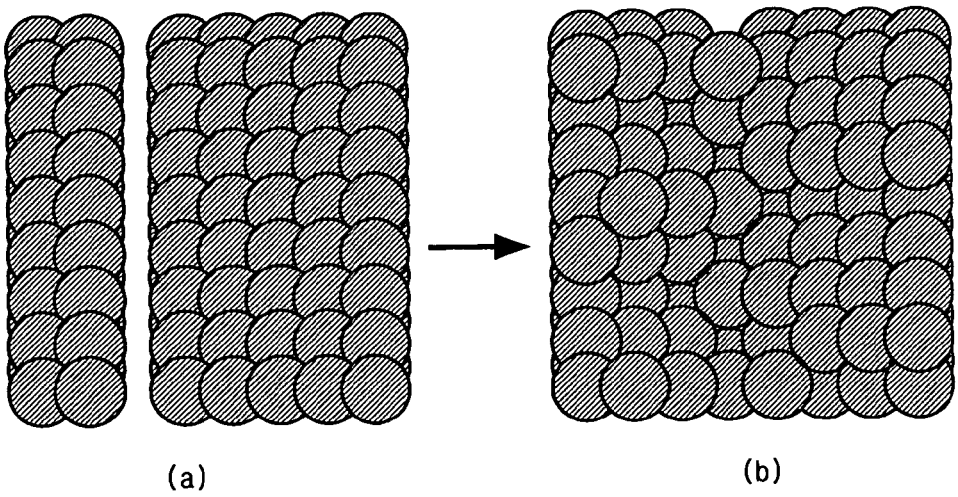

FIGS. 8A and 8B illustrate image improvement effects when the multi-pass printing operations of FIG. 7 are employed.

FIG. 8A illustrates the printing result of the present general inventive concept in comparison with the related art printing result if printing is performed in a draft mode, i.e., at a resolution of 1200×1200 dpi.

The part (a) of FIG. 8A illustrates an example of a multi-pass printing operation where a plurality of dots per color are arranged in a straight line in accordance with the inkjet printing in the related art. Referring to part (a) of FIG. 8A, it is noted that a white line, which affects the printing result, occurs in the final printed result in spite of the multi-pass printing when an irregular nozzle defect is present.

The part (b) of FIG. 8A, on the other hand, illustrates an effect obtained when printing is performed in a draft mode after a plurality of dots per color are arranged in a zigzag shape by the scattering portion 400. Referring to part (b) of FIG. 8A, it is noted that the white line that is clearly visible in part (a) of FIG. 8A is covered.

FIG. 8B illustrates the printing result according to one embodiment of the present general inventive concept in comparison with the related art printing result if printing is performed in a normal mode, i.e., resolution of 1200×2400 dpi.

The part (a) of FIG. 8B illustrates an example of a multi-pass printing operation wherein a plurality of dots per color are arranged in a straight line in accordance with the related art inkjet printing method. Referring to part (a) of FIG. 8B, it is noted that a white line, which affects the printing result, occurs in spite of the multi-pass printing even if the white line is thinner than that occurring in part (a) of FIG. 8A. The white line occurs when an irregular nozzle defect is present.

The part (b) of FIG. 8B, on the other hand, illustrates an effect obtained when the multi-pass printing is performed in a normal mode after a plurality of dots per color are arranged by the scattering portion 400 in a zigzag shape over the scattering area having one side with the dimension of 1/400 dpi. Referring to part (b) of FIG. 8B, it is noted that the white line that is clearly visible in part (a) of FIG. 8B is completely covered.

Figure 9:
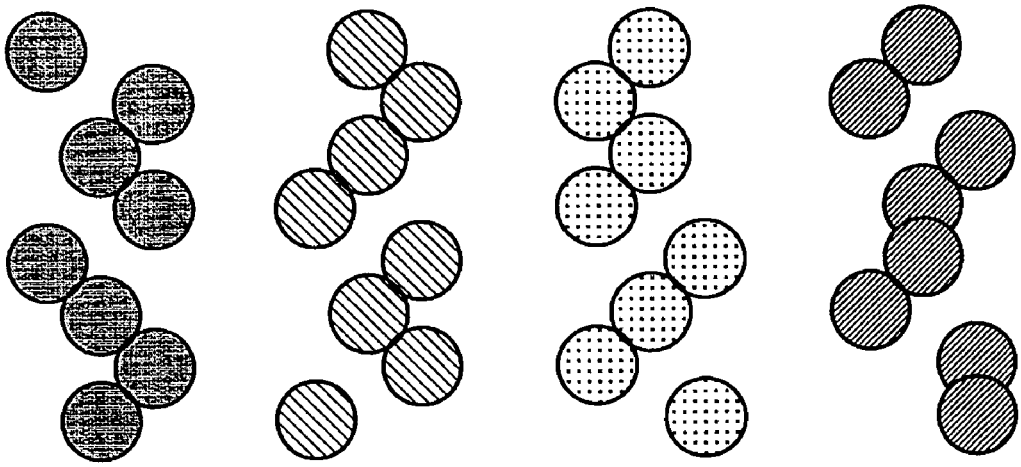
FIG. 9 illustrates exemplary image patterns generated by the dispersion portion illustrated in FIG. 4.

FIG. 9 illustrates exemplary image patterns generated by the dispersion portion 600 illustrated in FIG. 4.

Four-pass random patterns (one pattern for each of the four colors) are illustrated in FIG. 9 when a plurality of dots per color arranged by the scattering portion 400 in a zigzag shape over the scattering area are randomly rearranged by the dispersion portion 600. As illustrated in FIG. 9, different patterns per color are rearranged by the dispersion portion 600.

In the embodiment of FIG. 9, the nozzles corresponding to the respective dots are n−1th, nth, and n+1th nozzles, wherein these three nozzles are discharged in the order of rearrangement (dictated by the dispersion portion 600). Accordingly, the three nozzles may be selected in combination of (n−1), n, (n+1), or in combination of n, (n−1), (n+1), or in combination of n, (n+1), (n−1), or in combination of (n+1), n, (n−1), or in combination of (n+1), (n−1), n, or in combination of (n−1), (n+1), n.

If the dispersion portion 600 randomly distributes any one of the aforementioned combinations to perform image mapping, the head controller 700 allows corresponding nozzles to discharge ink, thereby printing the mapped image.

For example, the head controller 700 can control the nozzles to allow the nozzles to discharge ink in the order of (n−1), n, (n+1), n, (n−1), (n+1), n, (n−1), n, (n+1), and (n−1) in accordance with the modified nozzle selection pattern provided by the dispersion portion 600.

Figure 10A:
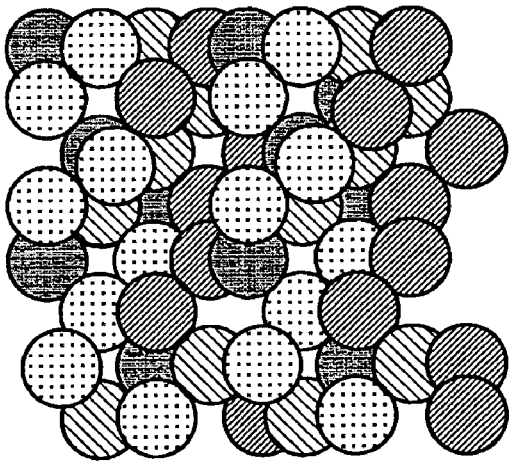
FIGS. 10A and 10B illustrate exemplary multi-pass printing results using the image patterns illustrated in FIG. 9.
Figure 10B:
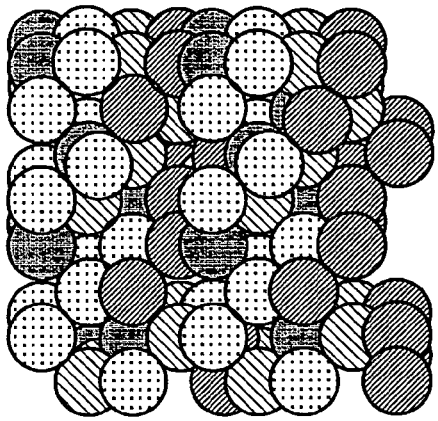

FIGS. 10A and 10B illustrate exemplary multi-pass printing results using the image patterns illustrated in FIG. 9.

If four colors are printed in a draft mode by random patterns arranged differently per each color illustrated in FIG. 9, the printing result can be obtained as illustrated in FIG. 10A.

Also, if four colors are printed in a normal mode by random patterns arranged differently per each color illustrated in FIG. 9, the printing result can be obtained as shown in FIG. 10B.

It is noted that the white line does not occur in the results illustrated in FIGS. 10A and 10B unlike the related art printing result (e.g., as illustrated in part (a) in FIG. 8A). Accordingly, a problem caused by an irregular defect in an inkjet printer's nozzle is solved.

Figure 11:
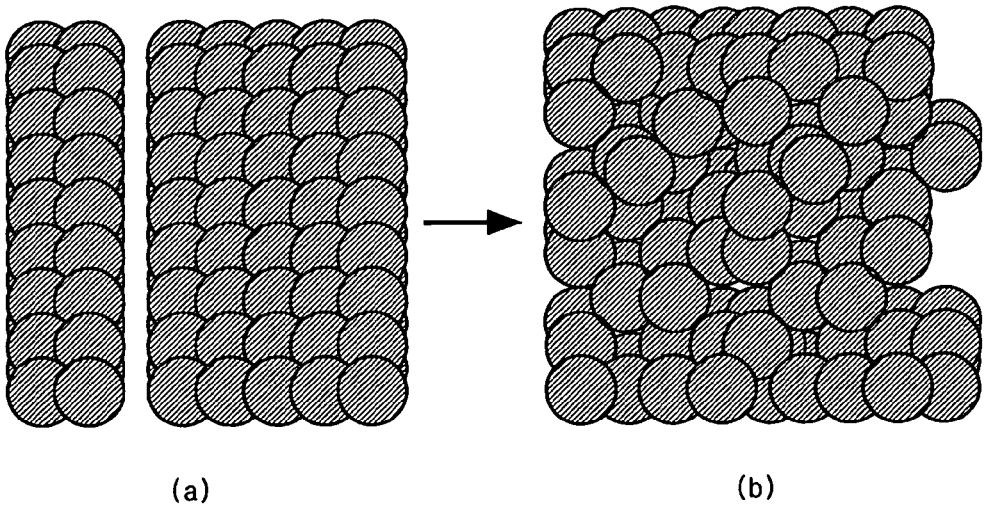
FIG. 11 illustrates exemplary image improvement effects when the image patterns of FIG. 9 are employed.

FIG. 11 illustrates exemplary image improvement effects when the image patterns of FIG. 9 are employed.

The part (a) of FIG. 11 illustrates an example of a multi-pass printing in a normal mode of printing when a plurality of dots per color are arranged in a substantially straight line in accordance with the related art inkjet printing. Referring to part (a) of FIG. 11, it is noted that a white line, which affects the printing result, occurs in spite of the multi-pass printing when an irregular nozzle defect is present.

The part (b) of FIG. 11, on the other hand, illustrates an effect that can be obtained when printing is performed in a normal mode after a plurality of dots per color are arranged by the scattering portion 400 in a zigzag shape over the scattering area having one side with the dimension of 1/400 dpi and dots are randomly rearranged by the dispersion portion 600.

Referring to part (b) of FIG. 11, it is noted that the white line that is clearly visible in part (a) of FIG. 11 is completely covered in part (b) of FIG. 11. It is also noted that the white line is covered in part (b) of FIG. 11 more clearly than in the embodiments of parts (b) in FIGS. 8A and 8B.

Figure 12:
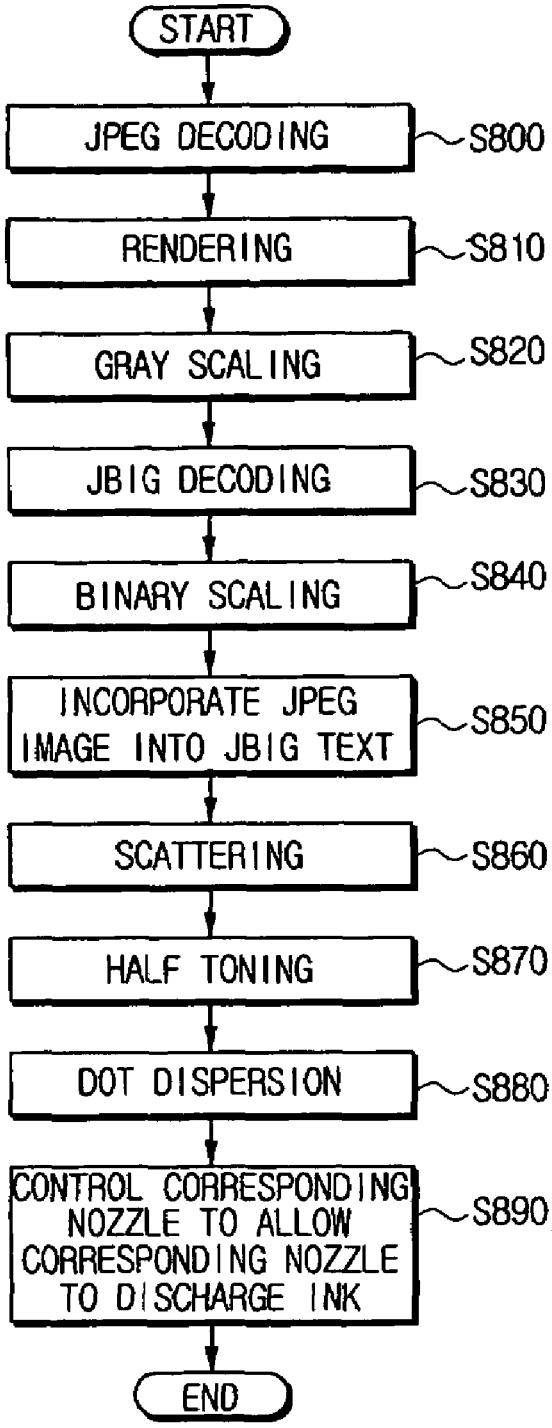
FIG. 12 is a flow chart illustrating a method of compensating an irregular nozzle defect in an array type inkjet printer according to an embodiment of the present general inventive concept.

FIG. 12 is a flow chart illustrating a method for compensating an irregular nozzle defect in an array type inkjet printer according to an embodiment of the present general inventive concept. The discussion of FIG. 12 is provided herein below with reference to the system elements illustrated in FIG. 4 and discussed supra with reference thereto.

The JPEG data compressed from the printer driver (not illustrated) are input to the image processor 100. The JPEG data input to the image processor 100 are decoded by the JPEG decoder 110 (operation S800).

The decoded JPEG data are converted by the rendering portion 120 into the coordinate system that can be output by the printer (operation S810), and then its size is controlled by the gray scaling portion 130 to adapt to printing resolution (operation S820).

Also, the JBIG data compressed from the printer driver (not illustrated) are input to the text processor 200. The JBIG data input to the text processor 200 are decoded by the JBIG decoder 210 (operation S830). The size of the decoded JBIG data is controlled by the binary scaling portion 220 (operation S840).

The image data and the text data, respectively processed by the image processor 100 and the text processor 200, are input to the incorporating portion 300, and the incorporating portion 300 incorporates the image data and the text data into printing data and outputs the incorporated printing data to the scattering portion 400 (operation S850).

As discussed hereinbefore, the scattering portion 400 corrects the nozzle selection pattern by performing scattering operation to arrange a plurality of dots per color in a zigzag shape over a predetermined scattering area. The number of dots in a diagonal in the zigzag shape may depend on the desired resolution of the printing data (operation S860).

The half toning portion 500 performs half toning for the printing data (S870). The dispersion portion 600 may rearrange the dots arranged by the scattering portion 400 by randomly dispersing them over the scattering area, thereby modifying the nozzle selection pattern (operation S880).

To print the printing data, the head controller 700 controls the printer head (not shown) to allow a corresponding nozzle to discharge ink using the nozzle selection pattern provided by the scattering portion 400 and modified by the dispersion portion 600, if provided (operation S890).

As described above, the method of compensating irregular nozzle discharge according to the various embodiments of the present general inventive concept is performed in the same multi-pass manner (albeit using a different nozzle selection pattern) as the related art multi-pass printing method. Thus, in the printing method of the present general inventive concept, the effect of a dead nozzle is removed. Furthermore, when the nozzle selection pattern is corrected by the scattering portion 400 and modified by the dispersion portion 600 and then used for printing of the printing data, the effect of an irregular nozzle defect (which cannot be solved using the conventional multi-pass printing methodology), can also be removed. Hence, image quality can be prevented from being deteriorated by irregular discharge characteristics of the array type print head. However, such irregular discharge characteristics may not be easy to solve physically without using the zigzag pattern-based printing discussed hereinabove.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An array type inkjet printer, which prints printing data in a plurality of ink colors using a nozzle selection pattern of ink discharge, the array type inkjet printer comprising:

a scattering portion to provide the nozzle selection pattern by arranging a plurality of ink dots per color in a zigzag shape over a predetermined ink scattering area; and a head controller to control discharge of ink from a nozzle in the inkjet printer according to the arrangement of dots in the nozzle selection pattern.

2. The array type inkjet printer as claimed in claim 1, wherein the scattering portion is configured to select a dimension of one side of the ink scattering area on the basis of a resolution selected for printing of the printing data.

3. The array type inkjet printer as claimed in claim 2, wherein the dimension of the one side of the ink scattering area corresponds to an inverse number of resolution lower than the resolution selected for printing of the printing data.

4. The array type inkjet printer as claimed in claim 2, wherein the scattering portion is configured to increase the number of the dots arranged in a diagonal direction in the zigzag shape in proportion to the dimension of the one side of the ink scattering area.

5. The array type inkjet printer as claimed in claim 1, wherein, as part of the zigzag shape, the scattering portion is configured to arrange at least one dot in left and right diagonal directions around a dot to be printed.

6. The array type inkjet printer as claimed in claim 1, further comprising a dispersion portion configured to modify the nozzle selection pattern by randomly rearranging the dots arranged in the zigzag shape by the scattering portion prior to dispersion of the dots over the ink scattering area.

7. A method of printing using an array type inkjet printer, which prints printing data in a plurality of ink colors using a nozzle selection pattern of ink discharge, the method comprising:

arranging, as part of the nozzle selection pattern, a plurality of ink dots per color in a zigzag shape over a predetermined ink scattering area; and controlling discharge of ink from a nozzle in the inkjet printer according to the arrangement of dots in the nozzle selection pattern.

8. The method as claimed in claim 7, further comprising:

selecting a dimension of one side of the ink scattering area on the basis of a resolution selected for printing of the printing data.

9. The method as claimed in claim 8, wherein the dimension of the one side of the ink scattering area corresponds to an inverse number of resolution lower than the resolution selected for printing of the printing data.

10. The method as claimed in claim 8, wherein the arranging the plurality of ink dots in the zigzag shape includes increasing the number of the dots arranged in a diagonal direction in the zigzag shape in proportion to the dimension of the one side of the ink scattering area.

11. The method as claimed in claim 7, wherein the arranging the plurality of ink dots in the zigzag shape includes arranging at least one dot in left and right diagonal directions around a dot to be printed.

12. The method as claimed in claim 7, further comprising modifying the nozzle selection pattern by randomly rearranging the dots arranged in the zigzag shape prior to dispersion of the dots over the ink scattering area.

13. An array type inkjet printer, which prints printing data in a plurality of ink colors using a nozzle selection pattern of ink discharge, the array type inkjet printer comprising:

a scattering portion to provide the nozzle selection pattern by arranging a plurality of ink dots per color such as to arrange at least one dot in left and right diagonal directions around a dot to be printed in a zigzag shape; and a head controller to control discharge of ink from a nozzle in the inkjet printer according to the arrangement of dots in the nozzle selection pattern.

14. The array type inkjet printer as claimed in 13, further comprising:

dispersion portion to rearrange the dots arranged by the scattering portion by randomly dispersing the dots over an ink scattering area.

15. A method of printing data in a multi-pass manner using a plurality of ink colors and a nozzle selection pattern having a plurality of ink dots per color, the method comprising:

substantially linearly aligning the dots in each the plurality of dots along a dimension of a predetermined ink scattering area: and arranging each of the plurality of dots per color in the nozzle selection pattern in a manner whereby dots in each of the plurality of dots are arranged in a zigzag shape along the dimension of the ink scattering area instead of the substantially linear alignment.

16. The method as claimed in claim 15, wherein the nozzle selection pattern having dots in each of the plurality of dots per color are randomly rearranged within the zigzag shape prior to disperse the dots over the ink scattering area.

17. The method as claimed in claim 15, wherein the ink scattering area having the dimension is selected to be an inverse number of resolution lower than the resolution selected for printing of the printing data.

* * * * *